United States Patent [19]

Herrmann

[11] 4,233,913

[45] Nov. 18, 1980

[54] SAFE DOOR

[76] Inventor: John C. Herrmann, 101 South Fuller Ave., Los Angeles, Calif. 90036

[21] Appl. No.: 68,948

[22] Filed: Aug. 23, 1979

[51] Int. Cl.[3] ..... E05B 63/00

[52] U.S. Cl. ..... 109/59 T; 109/64; 70/1.5; 70/119

[58] Field of Search ..... 109/59, 64; 70/1.5, 70/119

[56] References Cited

U.S. PATENT DOCUMENTS

| | | | |
|---|---|---|---|
| 488,960 | 12/1892 | Brintnall | 70/119 |
| 3,104,538 | 9/1963 | Roberts | 70/1.5 |
| 3,158,017 | 11/1964 | Guze | 70/1.5 |

*Primary Examiner*—Reinaldo P. Machado
*Attorney, Agent, or Firm*—Ralph B. Pastoriza

[57] ABSTRACT

The safe door comprises a circular body with a recess formed in one face defining a cylindrical wall. This wall has radial bores passing therethrough for guiding locking bolts received in the bores between extended locked positions and retracted open positions. A cam plate is positioned in the recess and includes peripheral cam slots coupled to the inner ends of the bolts. The arrangement is such that rotation of the cam plate between first and second positions will retract and extend the bolts simultaneously. Features of the invention include providing a central opening in the cam plate with notches so that the same can be driven between its first and second rotated positions by a cam plate driver centrally located which driver in turn supports the combination lock components. The clearance between appropriate driving lugs received in the notches is greater than the clearance between the outer edge of the cam plate and the inner wall of the door recess such that lateral movement of the cam plate resulting from radially inwardly directed blows on any one of the bolts will result in the diametrically opposite portion of the cam plate engaging the inner wall of the recess before it will engage any of the combination lock components disposed within the central opening of the plate thereby avoiding damage to these components.

8 Claims, 10 Drawing Figures

SAFE DOOR

This invention relates to safes or vaults and more particularly to an improved safe door of the type utilizing a radially moving bolt which may be extended or retracted to lock or open the door respectively.

BACKGROUND OF THE INVENTION

U.S. Pat. No. 3,158,017 issued Nov. 24, 1964 entitled BURGLAR PROOF SAFE LOCKING BOLT ASSEMBLY is illustrative of a typical prior art safe door construction of the type with which the present invention is concerned. Basically, safe doors of the type shown and described in this prior patent comprise or are made up of a massive body provided with a circular recess defining an annular wall. Bolt guiding bores extend radially through this wall for receiving bolts. The bolts in turn may be retracted and extended by an appropriate cam plate received in the recess and arranged to rotate between first and second positions. The inner ends of the bolts are provided with grooves receiving the outer edge of the cam plate and appropriate cam slots are provided through which pins extending transversely of the grooves in the ends of the bolts pass to hold the bolts captive to the cam plate. The arrangement is such that all the bolts involved, normally three spaced at 120°, are simultaneously retracted or extended by rotation of the cam plate through a given circumferential distance; for example, 30°.

The cam plate itself is normally rotated between its locking and open positions by a cam driver member capable of being rotated in turn by the outer combination lock knob on the door when the proper combination has been worked. Thus, when the proper combination is carried out, a lever member is caused to effect engagement with a drive disc element secured to the end of a spindle shaft connecting to the combination knob. Rotation of the knob will thus rotate the cam plate driver and thereby rotate the cam plate to retract the bolts and open the door.

While safe doors as above described have worked fairly well, there is still room for ample improvement. A major problem involved is the construction of the safe door in such a manner as to minimize the possibility of successful burglaries. In this latter respect, one of the most common means of burglarizing safes of the type described is to drill into a wall of the safe opposite the extending bolts and then attempt to drive the bolts radially inwardly as by an appropriate driving rod and sledge hammer. One prior art means for attempting to frustrate such action is illustrated in the aforementioned U.S. Pat. No. 3,158,017 wherein there is provided a triangular shaped plate member cooperating with the cam plate to distribute any inward force exerted on a bolt to the other two bolts involved thereby tending to drive these latter bolts outwardly. While there is no question that such construction makes it more difficult to force inwardly any one of the bolts, damage to the internal mechanism of the combination lock can occur even though the burglar may not be successful in forcing a bolt inwardly. First, because of the pin constructions coupling the bolts to the cam plate, the pins themselves tend to be sheared and while the triangular reinforcing plate may still prevent inward movement of the bolt, the shearing of the pins requires a complete overhauling of the safe at considerable expense.

Even more important is the fact that the combination lock components themselves normally disposed in the central portion of the recess are often severely damaged by simple wear and tear, dropping or banging the door against walls, or by intentional attempts to force one or more of the bolts radially inwardly. Such blows are transmitted to the combination lock components through the cam plate and can cause severe damage requiring complete replacement.

In addition to the foregoing problems associated with wear and possible burglaries of such safe doors, other problems exist in the simple operation itself of the safe door. For example, many prior art combination locks have fixed wheel post on which the tumblers or wheels for the combination lock rotate One consequence is that the pick-up pin on the driver disc can start to turn the first wheel or tumbler before the cooperating lever and fence assembly have cleared the gate in the wheel. The resulting condition is referred to as a "locked open" condition and can only be corrected by resetting the entire combination. Further, wear and friction occur in such locks utilizing a fixed wheel post, this friction occurring during the locking and unlocking movements of the drive plate, cam plate and so forth.

Another problem in conventional safe door operation is a tendency for the lever for the drive plate to hang up on the fence pin by friction. Such hang-up of the lever prevents it from dropping into the disc shaped driver connected to the combination knob spindle. This problem can be overcome by providing a positive rotational force to the tumbler post actuating cam lever assembly in a direction opposite to the rotational direction of the assembly required to open the bolts. The problem however is that the bolts will tend to return to their locked position once the dial knob is released. Thus, a user of the lock would be required to hold the knob in the unlocked position while attempting to open the safe door all of which is totally impractical and would not be acceptable in a proper safe door.

Still other problems with prior art safes involve general difficulty in the assembly and disassembly of various elements primarily because of the large number of elements involved and the requirement of special tools.

BRIEF DESCRIPTION OF THE PRESENT INVENTION

Bearing all of the foregoing considerations in mind, the present invention contemplates a greatly improved door safe wherein the above-described problems characteristic of the prior art are overcome.

More particularly, a safe door with a circular recess includes a cam plate of modified construction positioned in the recess with its peripheral outer edge having a given clearance with the inside wall of the recess. The cam plate itself also includes a central opening with notches and peripheral cam slots coupled to locking bolts for retracting and extending the bolts from the side of the door upon rotation of the cam plate between first and second positions. In accord with a first major feature of this invention, a cam plate driver supporting combination lock components is positioned within the central opening of the cam plate, the driver having driving lugs received in the notches with a clearance greater than the given clearance. With this arrangement any lateral movement of the cam plate as might result from a radially inwardly directed blow on one of the bolts, results in the diametrically opposite portion of the cam plate engaging the inner wall of the recess before any engagement of the cam plate with the cam plate driver and combination lock components whereby the latter components are protected from damage.

In addition to the foregoing, the safe door of this invention also provides a cam plate driver with an integrally formed wheel post arranged to support the combination lock wheel tumblers so that the same will rotate as a unit with the wheel post and the corresponding disc drive and drive lever components. Rotation of these components as a unit during locking and unlocking avoids the heretofore referred to "lock open" condition and moreover avoids wear and friction problems between the individual elements making up the combination lock components.

In accord with a still further feature of this invention, there is provided a ball detent indexing means for indexing the cam plate driver to positions corresponding to the first and second cam plate positions so that an appropriate "feel" is communicated to the user of the safe. Moreover, there is provided an over-center toggle spring construction biasing the cam plate driver into one or the other of these positions after it has crossed over an over-center position. As a consequence, possible hang-up of the lever on the fence pin is effectively prevented without requiring that the user hold the dial knob while attempting to open the safe door.

BRIEF DESCRIPTION OF THE DRAWINGS

A better understanding of the foregoing as well as many further features and advantages of this invention will be had by now referring to a preferred embodiment thereof as illustrated in the accompanying drawings in which.

DETAILED DESCRIPTION OF THE PREFERRED EMBODIMENT

Figure 1:
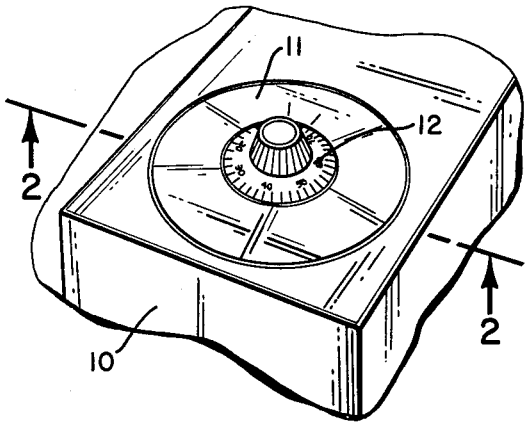
FIG. 1 is a fragmentary perspective view of a safe with a safe door designed in accord with the present invention in closed position.

Referring first to FIG. 1 there is shown a typical safe or vault 10 which might be used either commercially or in a private home. Safe 10 is closed by a safe door 11 provided with a conventional combination dial knob 12.

Figure 2:
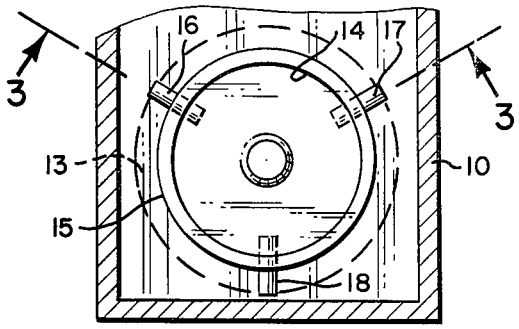
FIG. 2 is an underside fragmentary cross section looking generally in the direction of the arrows 2—2 of FIG. 1.

Referring specifically to the underside view of FIG. 2, it will be noted that the door 11 is in the form of a circular body provided with an exterior annular step 13 and a recess 14 formed in one face defining a cylindrical wall 15. Wall 15 is provided with radial bores receiving appropriate locking bolts 16, 17 and 18.

Figure 3:
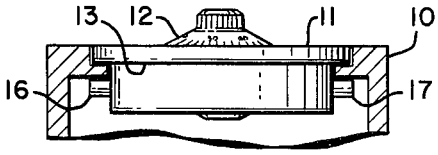
FIG. 3 is another fragmentary cross section along the section line designated 3—3 of FIG. 2.

Referring specifically to FIG. 3 it will be noted that when the locking bolts are extended as illustrated for the bolts 16 and 17, the door is secured and cannot be removed, the bolts themselves passing beneath a portion of the top wall of the safe 10 constituting a jam about the door periphery. When the bolts are retracted radially inwardly, the door 11 can readily be lifted from the opening to provide access to the safe.

Figure 4:
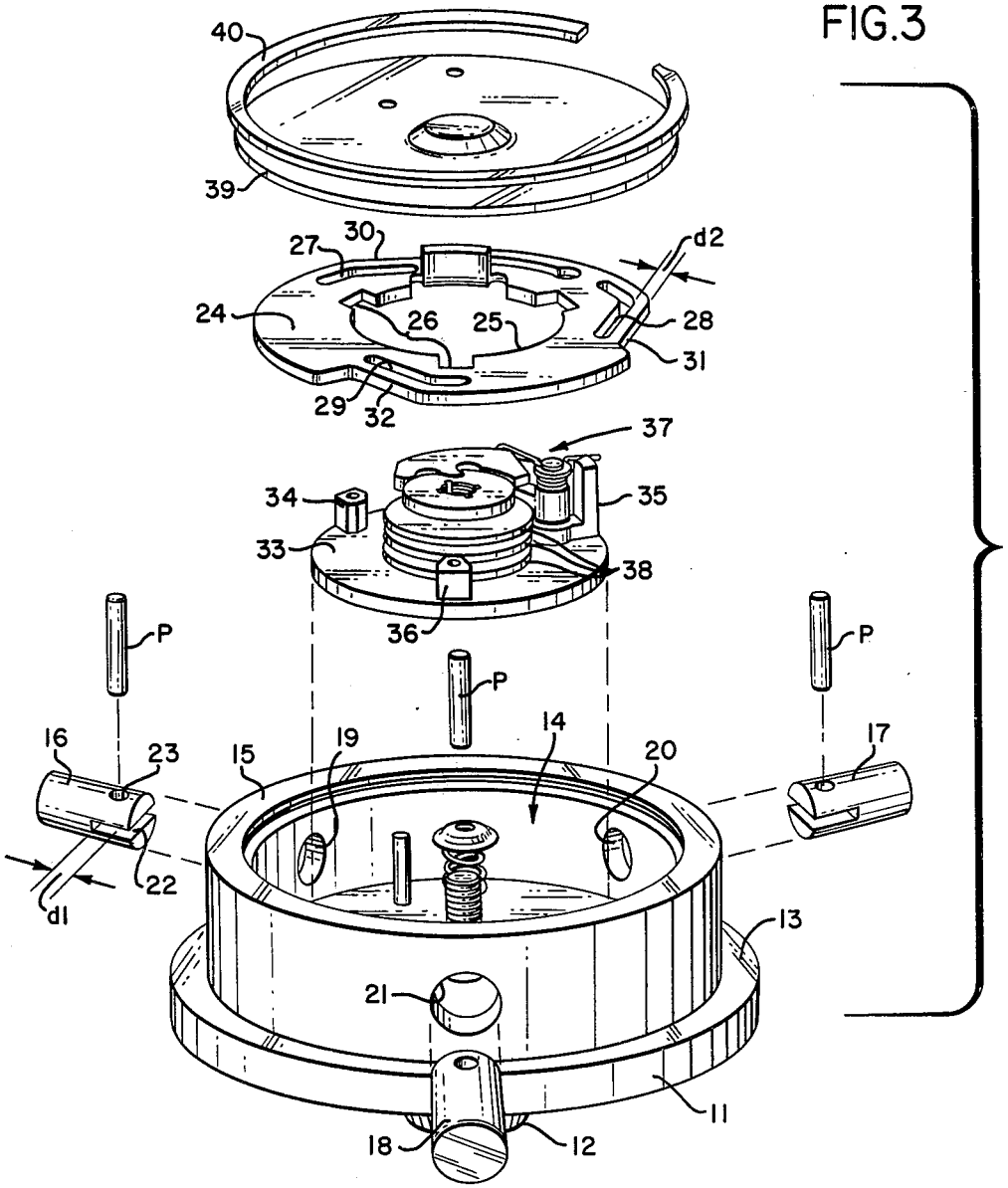
FIG. 4 is an exploded perspective view of basic components of the safe door of FIGS. 1 to 3.

Referring now to the exploded view of FIG. 4 the various radial bolt guiding bores in the annular wall 15 for the bolts 16, 17 and 18 are shown respectively at 19, 20 and 21. The inner end of each bolt such as for the bolt 16, for example, has a diametric groove 22 and a transverse pin receiving opening 23 passing at right angles across the groove at a given axial distance d1 from the inner end of the groove. Appropriate pins such as indicated at P are arranged to be received through the pin openings for coupling the ends of the bolts to an appropriate floating cam plate.

Referring now to the upper portion of FIG. 4, the referred to floating cam plate is illustrated at 24 having a central opening 25 with appropriate drive notches 26 formed in the opening. Adjacent to the outer edge of the cam plate 24 are provided appropriate cam slots following circumferentially and radially extending path segments. These cam slots are designated 27, 28 and 29.

In accord with a feature of this invention, given peripheral portions of the outer edge of the cam plate 24 follow the same circumferential and radial directions as the path segments of the slots. These peripheral portions are indicated at 30, 31 and 32 respectively. The geometry is such that the radial spacing between the slots and the corresponding outer edge of the cam plate is substantially constant over the circumferential extent of the slots. This substantially constant distance is indicated at d2 in FIG. 4.

Shown below the cam plate 24 in FIG. 4 is an integral cam plate driver and wheel post member 33. This driver includes upwardly extending driving lugs indicated at 34, 35 and 36, these lugs arranged to be received in the notches 26 of the cam plate 24 with a clearance all as will become clearer as the description proceeds.

Also shown on the cam plate driver 33 are various combination lock components designated generally by the arrow 37 and including tumbler wheels 38 carried by the cam plate driver and wheel post member.

Referring to the extreme top portion of FIG. 4, the basic components described thus far are completed by the provision of an appropriate rear cover plate 39 securing the elements within the recess and held in place by an appropriate snap ring 40.

Figure 5:
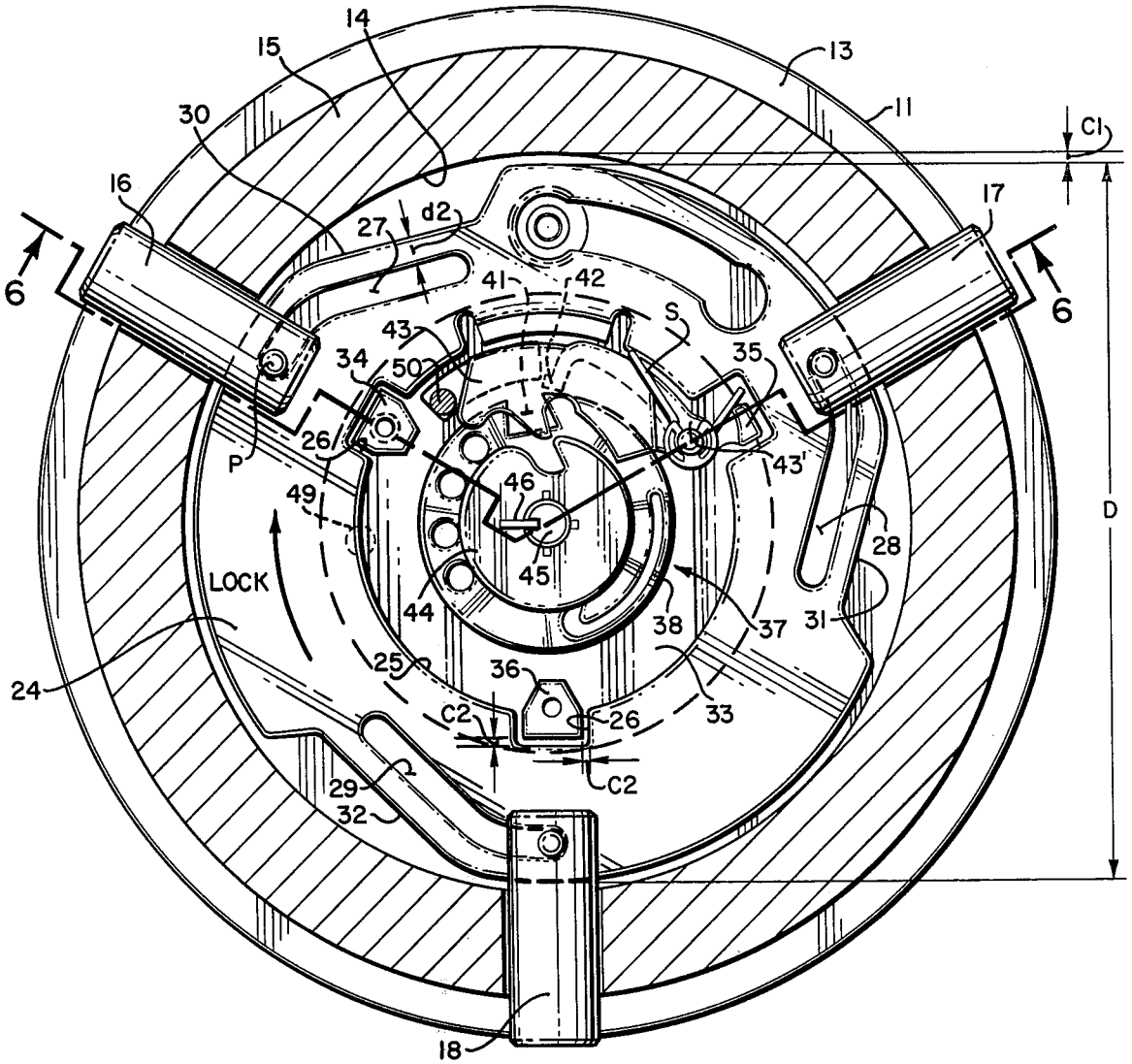
FIG. 5 is a greatly enlarged cross section of the rear of the safe with various ones of the components of FIG. 4 in assembled relationship and showing the cooperating bolts in full line in their locked positions.
Figure 6:
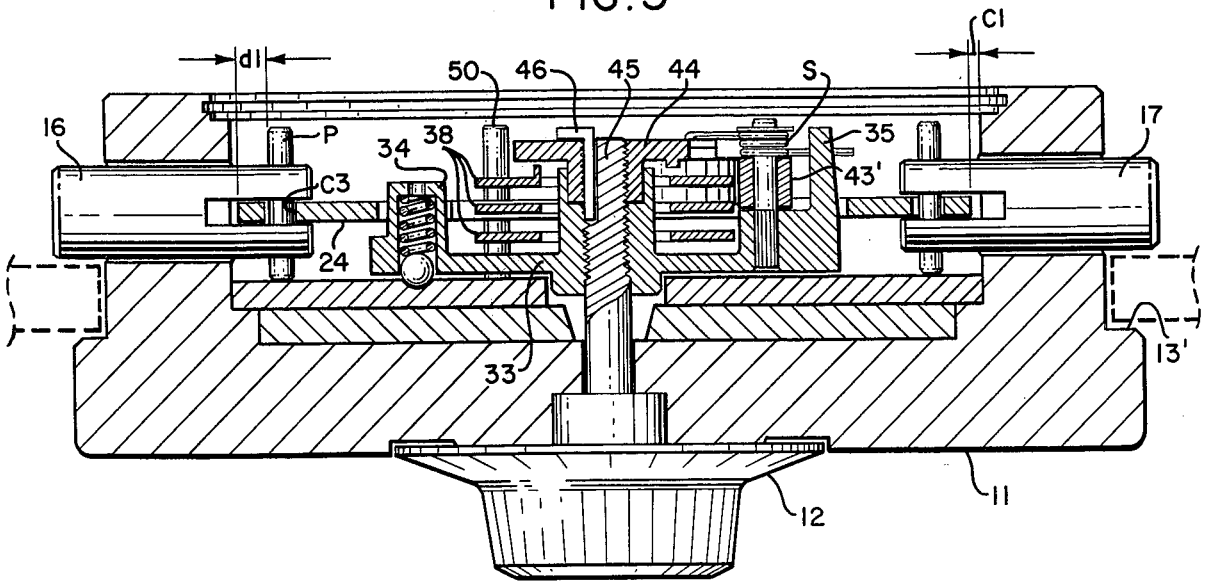
FIG. 6 is a cross section taken in the direction of the section line designated by the arrow 6—6 of FIG. 5.

Referring now to FIGS. 5 and 6 together, the manner in which the described components cooperate will be better understood. In these FIGURES, various elements described thus far in FIGS. 1 through 4 are designated by the same numerals.

Referring first to FIG. 5, the coupling of the inner ends of the various bolts 16, 17 and 18 to the outer edge of the cam plate 24 is clearly illustrated with the pins P passing through the appropriate cam slots. It will further be noted that when the cam plate 24 is received in the recess 14 the diameter of the plate as measured between points of the outer edge other than on the given peripheral portions 30, 31 and 32 is such as to provide a given close clearance C1 with the inside surface of the cylindrical wall 15 of the recess. With this close clearance, the cam plate can "float" but is limited in lateral movement in its own plane by such clearance.

It will also be noted in FIG. 5 that when the driving lugs 34, 35 and 36 of the cam plate driver 33 described in FIG. 4 are received in the notches 26 in the central opening of the cam plate 24, there is a clearance C2 between the drive lugs and notches. This clearance is purposely made greater than the clearance C1 so that a radially directed blow against a bolt will cause the cam plate to engage the inner wall of the recess on a diametrically opposite side before any engagement of the plate with the combination lock components so that the latter are protected.

Still referring to FIG. 5, the combination tumbler wheels 38 include appropriate gates 41 for receiving a lever catch indicated in phantom lines at 42 constituting an integral lower portion of a lever 43 coupled to the cam plate driver member 33 by pivot pin 43'. Lever 43 is arranged to be driven by a drive disc element 44 secured to the inwardly extending end of an axial shaft 45 connecting to the combination dial knob 12 such that rotation of the knob 12 will rotate the drive disc element 44. A key 46 received within an appropriate spline structure secures the disc 44 to the shaft rotation, the disc in the particular embodiment disclosed being threaded to the end of the shaft.

In the illustration of FIGS. 5 and 6, the lever 43 is shown in a position just prior to being received into the correspondingly shaped hooked portion of the drive disc 44 which can only occur when the proper combination has been worked. The proper combination has been worked when the various gates such as the gate 41 for the tumbler wheels all line up thereby permitting the catch 42 of the lever member 43 to be received therein so that the hook portion of the lever may be received within the receiving hook portion of the disc element 44.

When the lever 43 engages within the hook portion of the disc element 44, the combination dial knob 12 can be rotated to thereby pull the cam plate driver member 33 in a counterclockwise direction as viewed in FIG. 5 so that the driving lugs in turn will rotate the cam plate 24 in a counterclockwise direction between first and second positions to retract the various bolts.

The foregoing described assembly can best be seen in the cross section of FIG. 6 wherein it is evident that the combination lock components including the tumbler wheels 38 are all carried by the cam plate driver member 33, the tumbler wheels 38 surrounding a wheel post integrally formed at the central portion of the driver plate 33. Further, because of the engaging structure described for the drive disc 44 and lever 43, it will be clear that the entire assembly including the cam plate driver member 33 and integrally formed wheel post as well as the tumbler wheels themselves, drive disc and lever rotate as a unit between the referred to first and second positions in unlocking the door.

The foregoing described assembly constitutes a further important feature of this invention in that wear and friction is avoided between the various tumbler wheels and wheel post as well as other elements in executing locking and unlocking movements. In certain prior art structures as described heretofore, the wheel post supporting the tumbler wheels was fixed and there was a possibility of a "lock open" condition occurring should the first wheel become misaligned with the others. Having the complete driver and wheel post member together with the combination lock components all rotate together avoids such problems and further avoids any friction between the parts which would otherwise contribute to wear of the combination lock components.

A further feature of the described construction as shown in both FIGS. 5 and 6 is the provision of the single key 46 fitted within an appropriate spline in the dial knob shaft 45 and driver disc 44. Removal of this single key which can be accomplished manually permits ready unthreading of the driver disc 44 so that the various other elements can readily be disassembled without requiring special tools.

Referring specifically to the left portion of FIG. 6, the referred to axial distance between the pin and floor of the groove in the bolt such as the bolt 16 is designated again at d1. This particular distance when compared with the distance d2 between the slot and peripheral portion running parallel thereto is only slightly greater by an amount less than the clearance between the pin in the slot so that if a radially inwardly directed force is applied to the extending end of any one bolt, the force will be absorbed by the cam plate and annular wall of the body by engagement of the outer edge of the plate with the inner end of the groove of the bolt, and diametrically opposite portion of the plate with the inner surface of the annular wall. In other words, maximum use is made of the strength of the cam plate, any load being carried between the outer edge of the plate and the floor of the groove rather than on the pins.

The foregoing geometry thus inhibits successful burglaries by attempting to drive any one of the radial bolts inwardly since the full strength of the annular wall defined by the recess in the door body resists such movement when the close clearance is used up by lateral movement of the cam plate.

Figure 7:
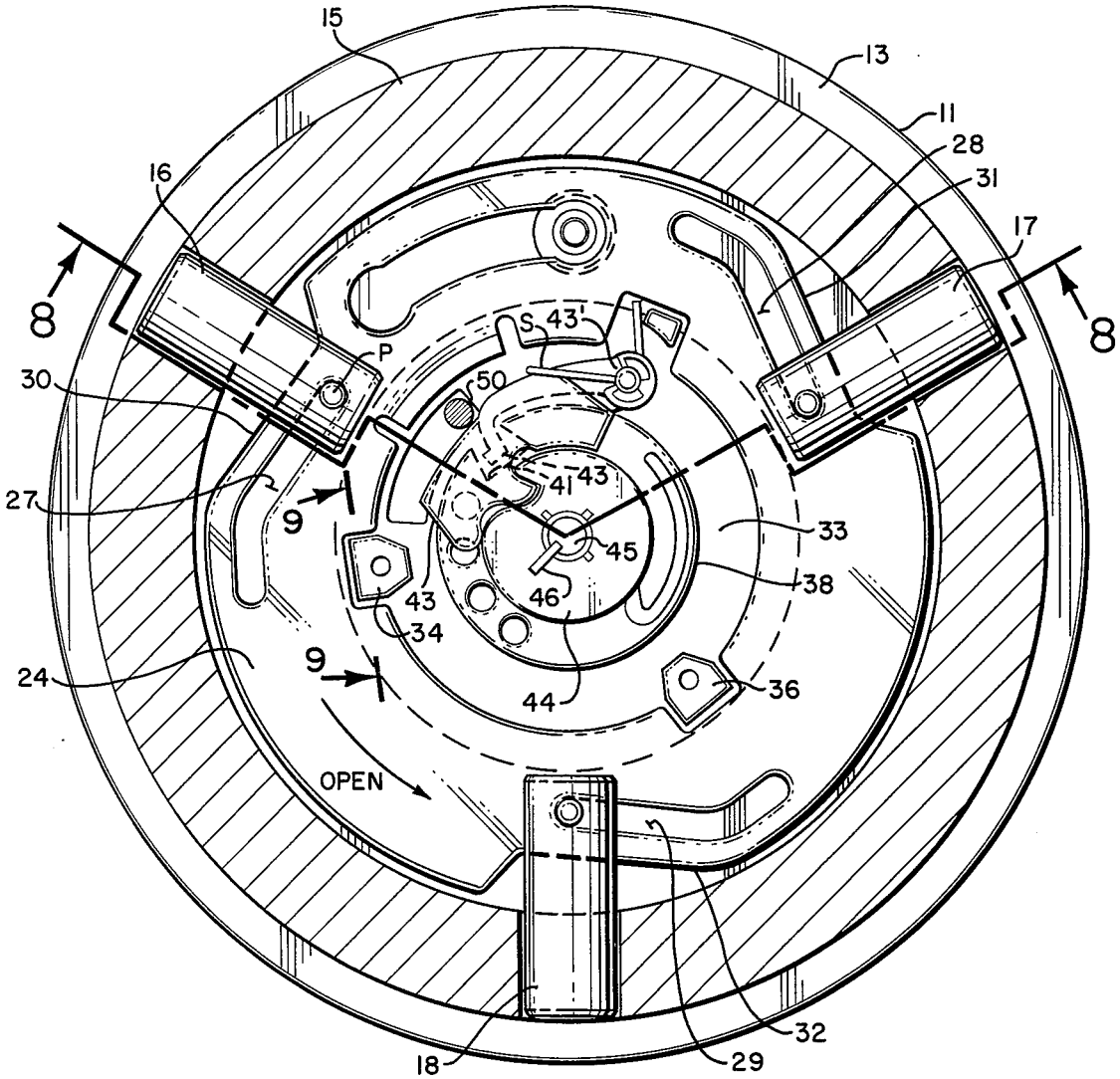
FIG. 7 is an underside view similar to FIG. 5 but illustrating the components in open position.
Figure 8:
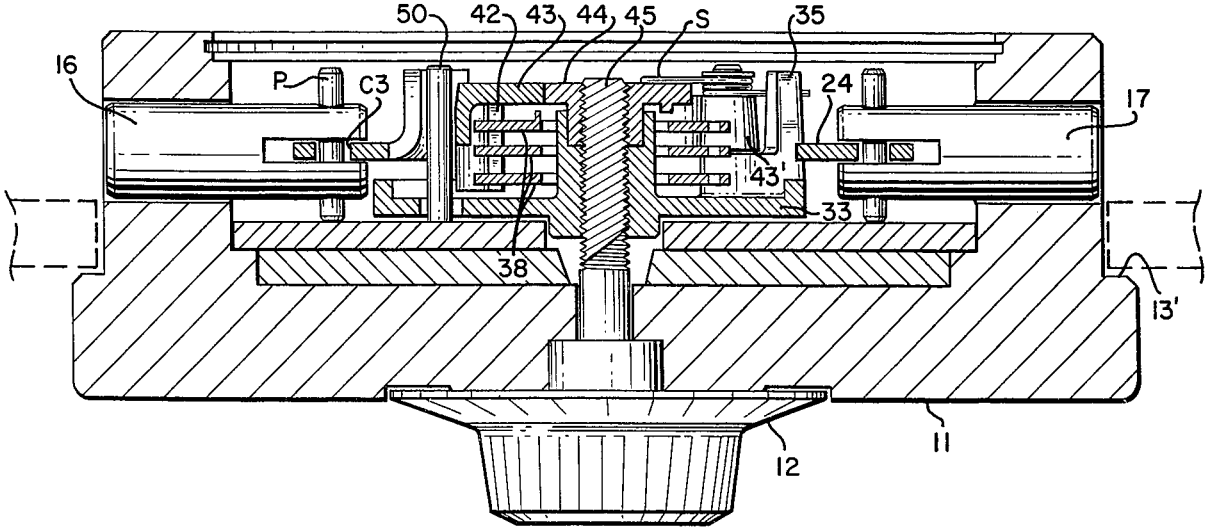
FIG. 8 is a cross section taken along the section lines designated by the arrows 8—8 of FIG. 7.

Referring now to FIGS. 7 and 8, there is illustrated the relative positions of the components after the combination dial knob has been moved to open position; that is, after the cam plate has been rotated in a counterclockwise direction from its first position illustrated in FIG. 5 to its open position wherein the various bolts are in a fully retracted state. The significance of the peripheral portions of the cam plate shown at 30, 31 and 32 can now be appreciated. If these peripheral portions did not follow the direction of the cam slots, the cam plate would bind because of engagement of the outer edge of the plate with the floor of the grooves in the bolts. In prior art structures, such problem was solved by simply making the grooves substantially deeper into the bolts. However, if such is done, then any radially inwardly directed blows on any one of the bolts would result in a shearing of the pins rather than engagement of the floor of the groove with the outer edge of the cam plate as in the present case.

FIG. 7 also illustrates the lever 43 in inter-engaging position with the driving disc 44, it being appreciated that when in such position, a counterclockwise rotation of the driving disc 44 as viewed in FIG. 7 will pull the lever member 43 and thus the cam plate driver member 33 in a similar counterclockwise direction by way of the pivotal coupling at 43'. This action in turn, as described heretofore, results in the various lugs such as 34, 35 and 36 moving the cam plate 24 in the desired counterclockwise direction.

FIG. 8 shows in cross section the various bolts in their fully retracted position wherein it will be evident that the door now can be removed readily from the safe opening.

A desirable feature of a door combination lock is to provide to the user a "feel" when the bolts are fully extended or fully retracted so that the user can readily be aware of the condition of the safe. Such is accomplished in the present invention by providing a ball-detent indexing means between the cam plate driver and floor of the recess to index the positions of the cam plate driver when the cam plate has been rotated by the driver to either the referred to first or second position.

Figure 9:
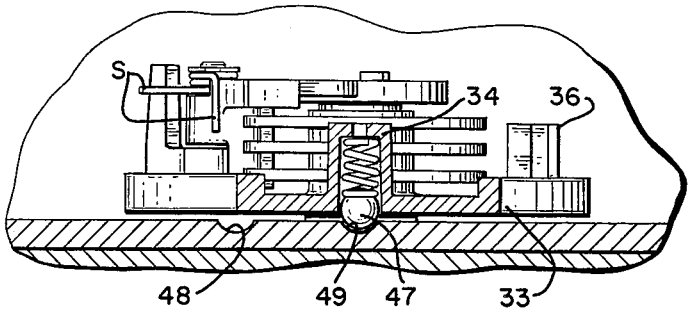
FIG. 9 is a fragmentary elevational view partly in cross section looking in the direction of the arrows 9—9 of FIG. 7.

In the fragmentary cross section of FIG. 9, such a ball-detent arrangement is illustrated as incorporated in one of the driving lugs such as the lug 34. As shown, there is provided a spring biased ball 47 within the lug 34 arranged to be indexed into either one of two indexing detents 48 and 49 in the floor of the recess. For the position illustrated in FIG. 9 wherein the cam plate driver 33 is in the unlocked position as shown in FIG. 7, the ball 47 is seated in the detent 49.

When the structure is rotated in a clockwise direction as viewed in FIG. 7 to rotate the cam plate in a clockwise direction, the ball 47 will seat in the detent 48 when the completely locked position has been attained.

In addition to the indexing means, there is also provided, in accord with the present invention, a toggle action spring means connected between the cam plate driver and door body biasing the driver to either said first or second position after the driver has crossed over an over-center point towards such position. This feature is important in positively preventing any accidental hang-up of the lever member on what is referred to as the fence pin.

Figure 10:
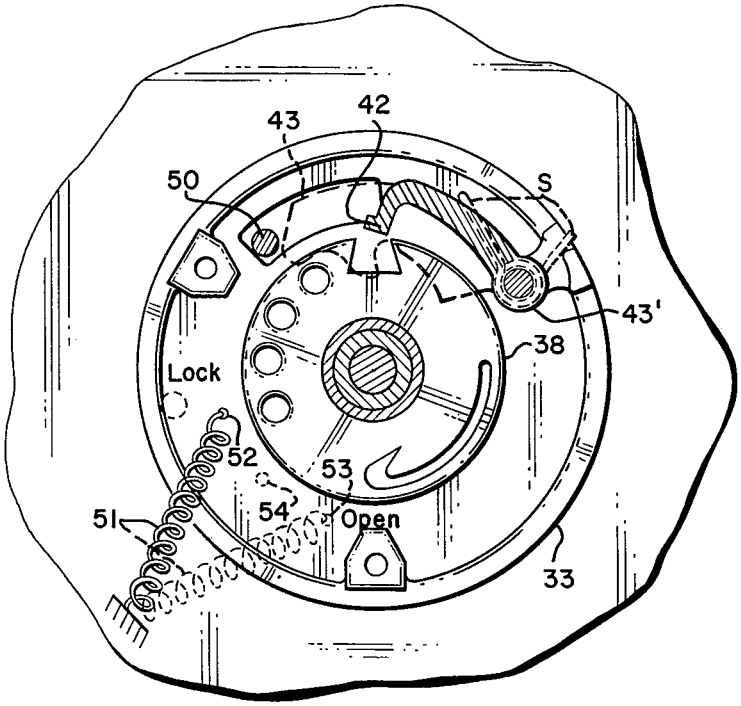
FIG. 10 is a fragmentary plan view partly in cross section of the central portion of the combination lock looking downwardly from the rear.

More particularly, and with reference to FIG. 10 the fence pin is shown at 50 and extends up from the floor of the recess and constitutes a stationary pin for holding the lever member 43 in its engaged position with the disc driver 44 as described in FIGS. 5 and 7 during movement to unlock or lock the door. A portion of the lever member 43 is shown in phantom lines in a position corresponding to that illustrated in FIG. 5; that is, immediately prior to being received in the drive disc hook 44. In FIG. 10, the catch 42 is clearly illustrated preparatory to being received in the aligned gates 41 of the tumbler wheels 48. It will be noted that the lever member as shown in phantom lines 43 is spaced from the fence pin 50. When the proper combination is attained, the spring S shown in FIG. 10 biases the catch 42 into the aligned gates 41 and thus will hold the lever pin in its hooked relationship with the driver disc 44. The toggle action spring described is schematically illustrated in FIG. 4 at 51 exerting a force to hold the cam plate drive member 33 in its first position.

In can now be appreciated with reference to FIG. 10 that as the cam plate driver member 33 is rotated counterclockwise as by the spindle shaft 45 working through the drive disc 44 shown in FIGS. 5 and 7, the toggle spring 51 will be compressed. In other words, the movement is initially resisted by the spring. However, approximately halfway through the first and second positions, an over-center point is reached and the spring 51 will thereafter urge the various elements in a counterclockwise direction to complete the movement towards the second or open position.

It can be appreciated from the foregoing that a very pleasant "feel" is communicated to the operator of the safe holding the combination dial knob 12 when rotating the knob shaft to operate the cam plate between the referred to first and second positions. In other words, in either position, the various components are biased towards such position after an over-center point has been reached so that it is not necessary for the operator to retain hold of the knob to assure that the elements will stay in their set position.

From all of the foregoing, it will thus be evident that the present invention has provided an improved safe door wherein many of the problems associated with prior art safes have been overcome. Not only is the safe door protected against inward blows on the bolts delivered accidentally or intentionally, but in general the structure is essentially immune to dropping and banging against walls and so forth and is thus much easier to live with under wear and tear conditions normally encountered.

I claim:

1. A safe door having a circular recess and including, in combination:

(a) a cam plate positioned in said recess with its peripheral outer edge having a given clearance with the inside wall of said recess, said cam plate having a central opening with notches and peripheral cam slots coupled to locking bolts for retracting and extending the bolts from the side of the door upon rotation of the cam plate between first and second positions; and (b) a cam plate driver supporting combination lock components positioned within said central opening of said cam plate, said driver having driving lugs received in said notches with a clearance greater than said given clearance, whereby any lateral movement of said cam plate as might result from a radially inwardly directed blow on one of said bolts, results in the diametrically opposite portion of the cam plate engaging the inner wall of said recess before any engagement of the cam plate with said cam plate driver and combination lock components so that the latter components are protected from damage.

2. A safe door according to claim 1, in which said cam plate driver includes an integrally formed wheel post about which combination lock wheel tumblers are positioned and carried; a combination knob spindle shaft passing axially through said wheel post terminating in a disc drive element; and a drive lever coupled to said cam plate driver for engagement with said disc drive element only when the proper combination has been worked so that rotation of said combination knob will rotate said disc drive element to exert a pulling force on said drive lever and thereby rotate said cam plate driver to in turn rotate said cam plate between said first and second positions, said drive lever, cam plate driver and wheel post, wheel tumblers and combination lock components all rotating as a unit between said first and second positions to eliminate friction therebetween during the unlocking and locking operations of said safe door.

3. A safe door according to claim 2, including detent indexing means between said cam plate driver and floor of said recess to index the positions of said cam plate driver when said cam plate has been rotated by the driver to either said first or second position.

4. A safe door including, in combination:

(a) a circular body having an exterior annular step and a recess formed in one face defining a cylindrical wall, said wall having radial bores passing therethrough;

(b) bolts received in said bores for guided radial movement between extended lock positions and retracted open positions, the inner end of each bolt having a diametric groove and a transverse pin receiving opening passing at right angles across said groove at a given axial distance from the inner end of said groove;

(c) a floating cam plate having a central opening with drive notches formed in the opening, and having cam slots adjacent to its outer edge following circumferentially and radially extending path segments, given peripheral portions of said outer edge in radial alignment with said path segments following the same circumferential and radial directions as the segments so that the radial spacing between the slots and the outer edge of the cam plate is substantially constant over the circumferential extent of the slots, said cam plate being positioned in said recess, the diameter of the cam plate between points of said outer edge other than on said given peripheral portions being such as to provide a given close clearance with the inside surface of said cylindrical wall so that said cam plate can "float" but is limited in lateral movement in its own plane by said clearance, said given peripheral portions of said cam plate being received in the grooves formed in the ends of said bolts;

(d) pins received in the transverse openings of the bolts to pass through said cam slots to thereby couple the ends of the bolts to the cam plate such that rotation of the cam plate from a first to a second position will retract said bolts into said body to their open positions, and rotation in a reverse direction from said second to said first position will extend said bolts to their locked positions;

(e) an integral cam plate driver and wheel post member positioned in said recess within said central opening in said cam plate, said driver having upwardly extending driving lugs received in said notches with a clearance greater than said given close clearance; and (f) combination lock components including tumbler wheels carried by said cam plate driver and wheel post member within said central opening in said cam plate, whereby said cam plate driver and wheel post member together with said combination lock components all rotate together as a unit when rotating said cam plate driver to thereby rotate said cam plate by engagement of said driving lugs with said notches between said first and second positions, and whereby said cam plate driver and wheel post member together with said combination lock components are protected against damaging engagement by said cam plate as a result of its "floating" characteristic and its said given close clearance relative to said annular wall of said recess should any one of said bolts be subject to a radially inwardly directed blow to move the cam plate laterally.

5. A safe door according to claim 4, in which said given axial distance of said pin from said inner end of said groove for each bolt is only greater than said constant radial distance between the cam slots and outer edge portions of said cam plate in radial alignment therewith, by an amount less than said given close clearance so that if a radially inwardly directed force is applied to the extended end of any one of said bolts, said force will be absorbed by said cam plate and annular wall of said recess by engagement of the outer edge of the plate with the inner end of the groove of said bolt, and diametrically opposite portion of the plate with the inner surface of said annular wall.

6. A safe door according to claim 5, including ball detent indexing means for said cam plate driver to index the driver to given first and second positions whereby a person operating the combination lock experiences an unmistakable feel when the door is actuated to either a locked or open condition.

7. A safe door according to claim 5, including a toggle action spring means connected between said cam plate driver and body biasing the driver to either said first or second position after the driver has crossed over an over-center point towards such position whereby a person operating the combination lock experiences an unmistakable feel when the door is actuated to either a locked or open condition.

8. A safe door according to claim 5, further including a combination knob spindle shaft passing axially through said wheel post terminating in a disc drive element; a drive lever coupled to said cam plate driver for engagement with said disc drive element only when the proper combination has been worked so that rotation of said combination knob will rotate said disc drive element to exert a pulling force on said drive lever and thereby rotate said cam plate driver to in turn rotate said cam plate between said first and second positions; and a single spline key securing said disc drive element to said spindle shaft whereby removal of the spline key permits ready removal of the disc drive element and hence the combination tumbler wheels from the wheel post of said cam plate driver member thereby providing easy assembly and disassembly of the combination lock components.

* * * * *